United States Patent [19]

Leppänen

[11] 4,431,501

[45] Feb. 14, 1984

[54] APPARATUS FOR ELECTROLYTIC POLISHING

[75] Inventor: Yrjö T. J. Leppänen, Pori, Finland

[73] Assignee: Outokumpu Oy, Helsinki, Finland

[21] Appl. No.: 286,037

[22] Filed: Jul. 22, 1981

[30] Foreign Application Priority Data

Aug. 5, 1980 [FI] Finland ..... 8024444

[51] Int. Cl.[3] ..... C25F 7/00; C25F 3/16; C25D 17/14

[52] U.S. Cl. ..... 204/224 R; 204/271; 204/274; 204/129.46

[58] Field of Search ..... 204/129.46, 224 R, 224 M, 204/271, 274, 129.43, 129.6

[56] References Cited

U.S. PATENT DOCUMENTS

| | | | |
|---|---|---|---|
| 2,539,455 | 1/1951 | Mazia | 204/129.46 |
| 2,540,602 | 2/1951 | Thomas et al. | 204/224 R X |
| 2.961,395 | 11/1960 | Icxi | 204/224 R |
| 3,637,468 | 1/1972 | Icxi et al. | 204/271 X |
| 3,894,925 | 7/1975 | Inoue | 204/274 X |
| 4,125,444 | 11/1978 | Inoue | 204/129.43 |
| 4,190,513 | 2/1980 | Jumer | 204/224 R |
| 4,280,891 | 7/1981 | Neelameggham | 204/274 X |

*Primary Examiner*—Donald R. Valentine

*Attorney, Agent, or Firm*—Brooks, Hait, Haffner & Delahunty

[57] ABSTRACT

A movable apparatus for local electrolytic polishing of metal surfaces is disclosed, the apparatus having an arm, a supported soft surface which is attached to the arm and intended to be brought against the metal surface to be polished, and members for conducting cathodic current to this soft surface and for conducting anodic current to the metal surface to be polished. In the apparatus the supported soft surface is of an absorbent material, which is connected to the electrolyte container in order to cause electrolyte to be absorbed into the absorbent material, as electrolyte is transferred to the polished surface when the apparatus is moved. The electrolyte container may be a trough attached to the arm, the bottom of the trough supporting the absorbent material attached to its lower surface and extending to inside the trough, and the absorbent material may be some acid-resistant wadding.

3 Claims, 2 Drawing Figures

APPARATUS FOR ELECTROLYTIC POLISHING

BACKGROUND OF THE INVENTION

The present invention relates to an apparatus which can be used for local electrolytic polishing and which can be moved manually or connected to a moving mechanism. The apparatus is equipped with an electrically insulated handle, and it is intended substantially for the electrolytic polishing of areas of surface damage possibly produced during the transport and/or handling of large polished pieces and/or unpolished surfaces produced during the joining of large polished pieces. The apparatus can be used for polishing large continuous surfaces when it is connected to a moving mechanism.

U.S. Pat. No. 4,176,036 discloses an electrode for local electrolytic coating. This coating apparatus is intended for electrolytic coating by a relatively soft metal. The said soft metal serves as an anode in the circuit. The coating apparatus has an electrolytically insulated handle and a beam member of a substantially harder metal, attached to the handle. The beam member, furthermore, has a number of conical openings. The anode of the circuit is in close contact with one side of the beam member, and the anode has protrusions which completely fill the openings in the beam part. The protrusions have flat terminal areas, and on the center line of the terminal areas they extend, at the level of the other side of the beam, towards the conical openings and keep the anode of soft metal in close contact with the beam part.

It is known that large pieces can be surface treated, e.g. polished, in stages as follows:

1. By dividing the piece into as small parts as possible and by polishing each part separately and not attaching the parts to each other until they are at their place of use, 2. by dividing the piece into a few smaller partial entities and by carrying out the further treatment as in point 1, 3. by polishing the piece when the piece is whole.

The polishing of a large, massive piece as a whole in accordance with point 3 is difficult, since the size of the polishing tanks sets its limitations. In addition, the costs incurred from the polishing of a large piece are high, since large amounts of polishing electrolyte are necessary. Furthermore, the transportation of a large piece from the polishing place to the place of use is difficult.

After the polishing of the parts and/or partial entities of a large piece in accordance with points 1 and 2, the parts and/or partial entities are advantageously not attached to each other by mechanical attachment members and/or, for example, by welding until they are at their place of use. Owing to the handling and/or transportation, unpolished surfaces are produced in the piece, and the polishing of these surfaces is no longer possible or profitable in a normal electrolytic tank, since the surfaces are small compared with the surface area of the entire large piece. Also, a surface fulfilling special requirements is usually not obtained by mere mechanical polishing of the surfaces.

The object of the present invention is to provide an apparatus for electrolytic polishing, the apparatus being easy to move as compared with the state of the art described above. Electrolytic polishing requires a continuous supply of a liquid electrolyte, which must remain continuously between the electrodes, i.e. the cathode and the anode. Binding of the electrolyte is not required in polishing according to the state of the art described above, since the pieces to be polished are immersed in the electrolytic tank. Keeping the liquid electrolyte between the electrodes in tanks intended for polishing causes no difficulty, but when a movable electrode is used, the problem is how to polish continuously without stoppages due to the addition of electrolyte.

SUMMARY OF THE INVENTION

According to the present invention, there is provided a movable apparatus for local electrolytic polishing of metal surfaces in which the supported soft surface is of an absorbent material, which is connected to the electrolyte contactor in order to cause electrolyte to be absorbed into the absorbent material, as electrolyte is transferred to the polished surface when the apparatus is moved.

In the apparatus according to the invention, the liquid electrolyte is bound between the electrodes by means of an absorbent material, preferably acid-resistant wadding, wound around the electrode serving as the cathode in the circuit, for the duration of the polishing.

The apparatus according to the invention for electrolytic polishing can easily be moved manually. Thus it is possible to carry out, advantageously at the place of use of the large pieces, repolishing and/or primary polishing of any rough spots which are on the surface of substantially large polished and/or unpolished pieces or which are possibly created on such surface for various reasons.

When the apparatus according to the invention is connected to a moving mechanism, it can also be used for polishing large continuous surfaces. This makes it possible, for example, in cases of damage, to polish such surfaces rapidly at the place of use without specific transport to an electrolytic tank for polishing.

Even though the apparatus according to the invention has a small electrolysis surface, its operating speed is high, since electrolyte can be fed continuously.

DESCRIPTION OF THE PREFERRED EMBODIMENTS

Figure 1:
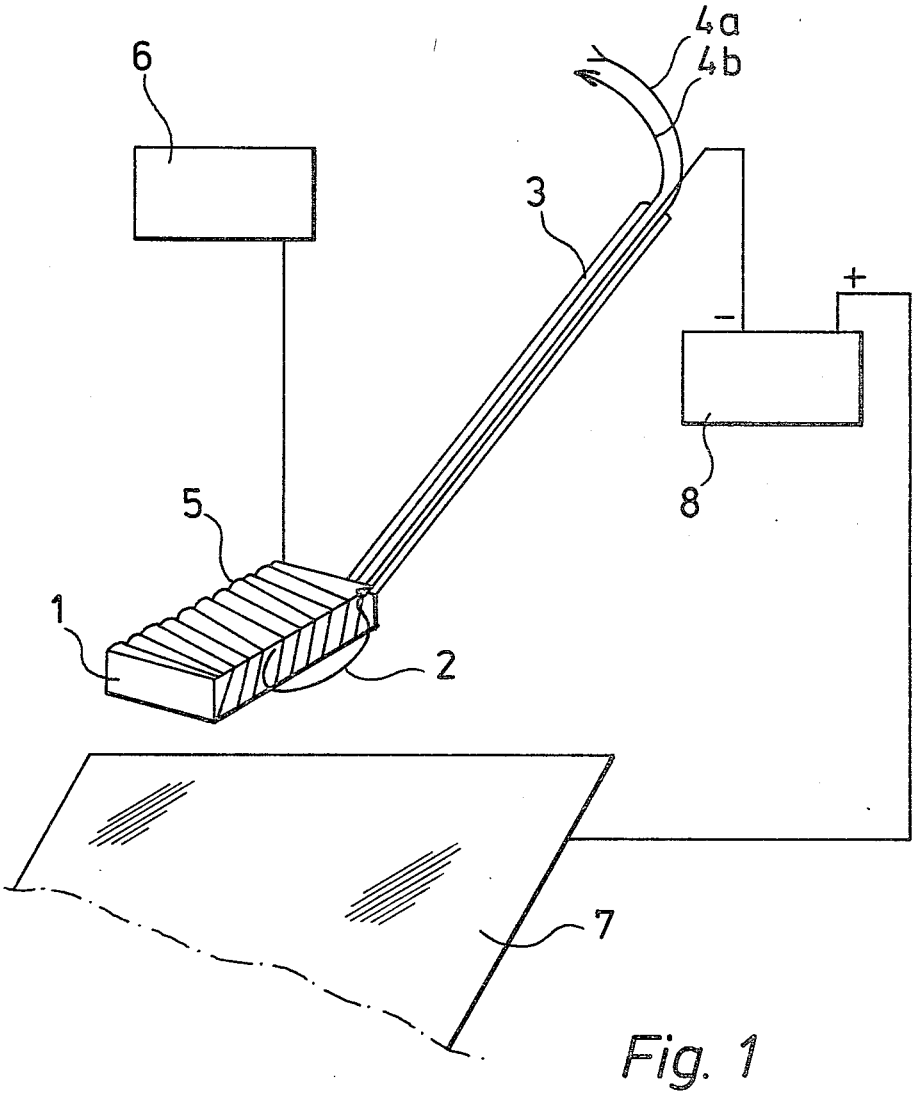
FIG. 1 depicts the apparatus, connected to a circuit.

The apparatus according to the invention for electrolytic polishing serves as the cathode in polishing. The cathodic current is conducted to a coil 2, which is located in a metal box 1, which is shown in FIG. 1 with is right side sectioned so that FIG. 1 shows the coil 2 located in the metal box. The coil 2 is water-cooled, and the cooling water is directed to the coil 2 and away through pipe 4*a* and respectively pipe 4*b*. The cooling pipes 4 run in the arm 3. The current cables to the coil 2 can also be directed via the arm 3, which is in such a case electrically insulated. The current cables to the coil 2 can also be led directly to the metal box 1. Around the metal box 1 there is wound absorbent material 5, which binds in itself the electrolyte necessary for polishing, the electrolyte being fed from a container 6. The container 6 can be separate from the metal box 1, or it can be connected to the box itself, and electrolyte can be fed continuously from the container into the absorbent material.

The surface 7 to be polished is connected as an anode in the circuit 8 of the apparatus according to the invention. In this case the electrolyte bound in the absorbent material reacts with the anode surface, polishing the surface in a manner known per se.

Figure 2:
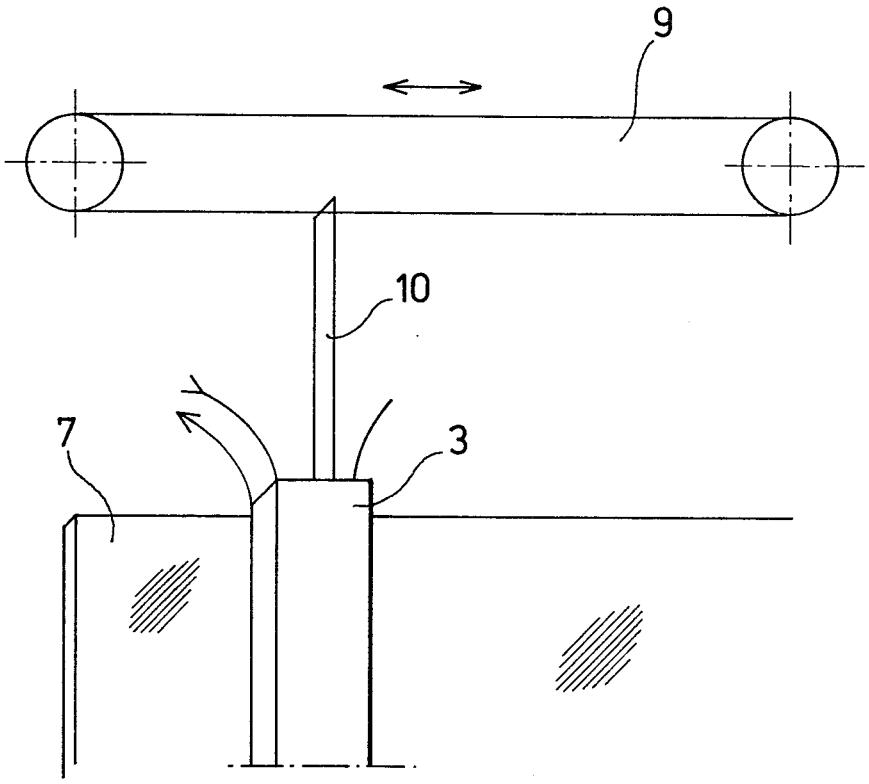
FIG. 2 depicts the upper end of the arm in the apparatus, connected to the moving mechanism.

The apparatus according to the invention can be attached to the moving mechanism 9 by means of an auxiliary arm 10, attached to the arm 3, as shown in FIG. 2. In this case it is possible to polish advantageously even large metal surfaces 7 at the place where they are used.

What is claimed is:

1. A movable apparatus for local electrolytic polishing of metal surfaces, the apparatus comprising: an arm, a supported soft surface which is attached to the arm and intended to be brought against the metal surface to be polished, the supported soft surface being of an absorbent material, which is connected to an electrolyte container in order to cause electrolyte to be absorbed into the absorbent material, as electrolyte is transferred to the polished surface when the apparatus is moved; and members for conducting cathodic current to this soft surface and for conducting anodic current to the metal surface to be polished, and in which the absorbent material surrounds a box, which box contains a coil to which cathodic current is conducted and including cooling water pipes running through the arm for cooling the coil.

2. A movable apparatus for local electrolytic polishing or metal surfaces, the apparatus comprising: an arm; a supported soft surface which is attached to the arm and intended to be brought against the surface to be polished, the supported soft surface being of an absorbent material, which surrounds a box attached to the arm which is connected to an electrolyte container in order to cause electrolyte to be absorbed into the absorbent material as electrolyte is transferred to the polished surface when the apparatus is moved, said box comprising a water-cooled coil, the power cables leading through said arm to conduct cathodic current to said coil, said arm being electrically insulated; and cooling pipes running through the arm for cooling the coil.

3. The apparatus according to claim 2, in which the power cables connected to the coil are led directly to the box.

* * * * *

UNITED STATES PATENT AND TRADEMARK OFFICE

CERTIFICATE OF CORRECTION

PATENT NO. : 4,431,501

DATED : February 14, 1984

INVENTOR(S) : Yrjo T. J. Leppanen

It is certified that error appears in the above-identified patent and that said Letters Patent are hereby corrected as shown below:

In the Claims:

Column 4, Claim 2, line 7:

"or metal surfaces" should read --of metal surfaces--.

Signed and Sealed this

*Twenty-fourth* Day of *April 1984*

[SEAL]

*Attest:*

GERALD J. MOSSINGHOFF

*Attesting Officer*

*Commissioner of Patents and Trademarks*